United States Patent [19]

Coats

[11] 4,114,580

[45] Sep. 19, 1978

[54] DISTRIBUTION RECTIFIER FOR INLET MANIFOLD SYSTEMS

[76] Inventor: Ronald Galen Coats, Box 595 Rte. #1, Lexington, Ind. 47138

[21] Appl. No.: 808,054

[22] Filed: Jun. 20, 1977

[51] Int. Cl.[2] ..... F02M 29/04

[52] U.S. Cl. ..... 123/141; 48/180 M

[58] Field of Search ..... 123/141, 122 AB; 48/180 M, 180 H, 180 R; 261/14 S

[56] References Cited

U.S. PATENT DOCUMENTS

| | | | |
|---|---|---|---|
| 1,074,136 | 9/1913 | Parker | 48/180 R |
| 1,118,919 | 12/1914 | Canda | 48/180 R |
| 1,453,656 | 5/1923 | Bonnell | 48/180 R |
| 1,722,367 | 7/1929 | Cogan | 48/180 R |
| 4,015,575 | 4/1977 | Fox | 48/180 R |

FOREIGN PATENT DOCUMENTS

| | | | |
|---|---|---|---|
| 1,471,777 | 4/1977 | United Kingdom | 123/141 |

*Primary Examiner*—Tim R. Miles

*Attorney, Agent, or Firm*—Gilbert E. Alberding

[57] ABSTRACT

A distribution rectifier is described to render a uniform gasoline - air mixture for engines normally using a carburetor system and an associated manifold system connected thereto, the distribution rectifier comprising a foraminous cylindrical member having openings at its ends, a foraminous curved member attached along the peripheral edge to said cylindrical member, the curved member having a major orifice coextensive with the opening of said cylindrical member, and a minor orifice defined at the apex thereof, said minor orifice being situated axially within and substantially at the center portion of said cylindrical member.

8 Claims, 4 Drawing Figures

DISTRIBUTION RECTIFIER FOR INLET MANIFOLD SYSTEMS

BACKGROUND OF THE INVENTION

This invention relates to novel and useful improvements in foraminous devices for providing means for volatizing liquid substances. More particularly, this invention relates to a new distribution rectifier configuration for assisting in the atomization of liquid fuel with air mixtures normally utilized in sundry carburetion apparatus of the automotive and other internal combustion engine arts.

As is known the principal function of a carburetor is to supply a mixture of air and gasoline in proper proportions for all speeds and loads of an engine and the quantity of air - gasoline mixture supplied by the carburetor is conventionally controlled by some type of throttle valve means. Further, the atomization of gasoline into very minute particles that can be carried with an air stream depends to a large extent on the velocity of the gasoline jet means as it issues from a given carburetor orifice. The mixing of the atomized gasoline droplets is facilitated by turbulence caused by a number of factors including pulsating flow, changes of velocity, reversal of direction of flow of the air - gasoline mixture in the manifold and intake systems.

In general liquid gasoline collects on the walls and bottom portions of a manifold system and is forthwith readily swept along with drawn air entering the combustion cylinder of the engine. Heat is usually supplied to the liquid fuel by means of a "hot spot" or "hot plate" located in the intake manifold system just below the point where the carburetor is mounted. The heat is derived from the hot exhaust gas as it passes through the exhaust manifold on its way to the cylinder. In practice in constructing the intake and exhaust manifold they are brought close to each other and separated generally by a thin metal plate member.

Admittedly, there are numerous devices for assisting and improving gasoline distribution associated with standard carburetor systems. In particular, there are various devices comprising screened structures or similar materials that may be readily interpositioned between a given carburetor and the manifold system. These devices do assist in maintaining the fluid fuel away from the walls and bottom portions of the manifold system. Apparently, liquid fuel clings momentarily to such portions and therefore the fuel comes in contact with such devices where the fuel is instantly and finely atomized in its advance to the combustion cylinder. In general, these sundry devices in being fitted between the carburetor and manifold system do take on various sizes and shapes ranging from a mere piece of metal gauze to more complex devices having miniature propellers and intricate vanes associated therewith and designed to properly admix the fluid fuel.

Seemingly there is a tendency for uneven distribution of fluid fuel when passing through a conventional butterfly-type throttle valve means. Moreover, there is apparently some tendency to distribute the fluid fuel on one side or portion of the duct means upon leaving the carburetor outlet than on the other. As already stated there are numerous means employed to resolve this tendency since in a ideal situation there should be no uneven distribution of fluid fuel as this would markedly effect the effiency of an engine. In order to intimately mix the fluid fuel and air the aforementioned devices have been widely employed. Many of these devices have simply been used to either substantially atomize or vaporize the fluid fuel with varying degrees of success.

It has been found in accordance with this invention that a rather simplistic design and construction afford a highly uniform distribution of volatized fuel with an attendant savngs in fuel comsumption.

SUMMARY OF THE INVENTION

It is accordingly an object of the present invention to provide a distribution rectifier device having few functional parts and of unitary and economic construction.

It is another principal object of the invention to provide a device of the character herewithin described which enhances the atomization-volatilization of a fuel mixture used in conventional carburetion systems.

It is another object of this invention to provide a device which renders uniform gasoline distribution and does away with patchy fuel mixtures.

It is another main object of this invention to provide a device that can be easily installed in various internal combustion engines to assist in intimate mixing of gasoline and air so as to effectively utilize the fluid fuel.

It is still another object of this invention to provide means for an internal combustion engine having associated therewith a carburetor; the means providing proper atomization-vaporization characteristics for liquid fuel in such a manner as to increase the general efficiency of said engine.

A further object of this invention is to provide a distribution device having a regulating and stabilizing effect associated therewith.

These and other objects of the invention will become more readily apparent from a review of the specification, claims, and a study of the attached drawing.

Briefly, in accordance with this invention a distribution rectifier is described and claimed, said rectifier comprising a foraminous cylindrical member having openings at its ends, a foraminous curved member attached along the peripheral edge to said cylindrical member, said curved member having a major orifice coextensive with one of the openings of said cylindrical member, and a minor orifice defined at the apex of the curved member, said curved member being coaxial with said cylindrical member and extending into the cylindrical member to about the central portion thereof.

The aforementioned features with the objects and advantages which become subsequently apparent reside in the details of construction and operation as more fully hereinafter described and claimed, reference being had to the accompanying drawing forming a part hereof, wherein like numerals refer to like parts throughout.

DETAILED DESCRIPTION

Figure 1:
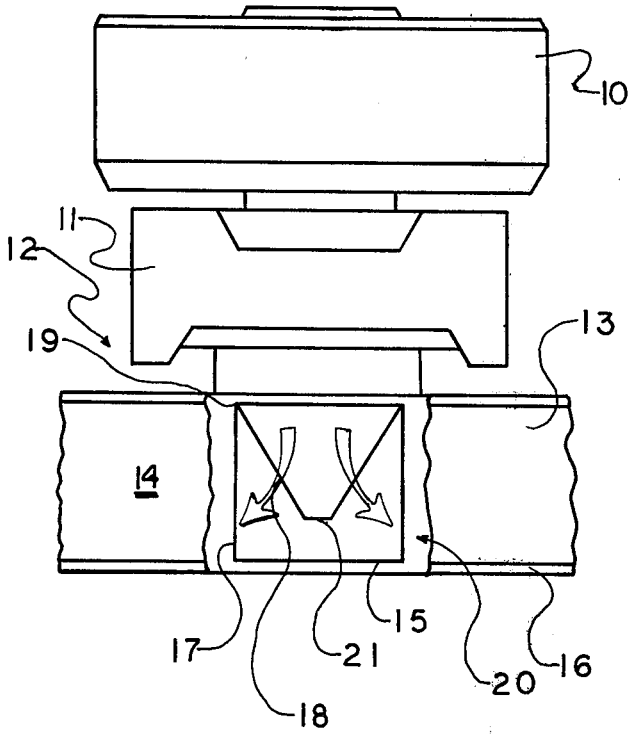
FIG. 1 is a front elevation, partially schematic of a carburetion system and an intake manifold with a schematic view of the distribution rectifier of the instant invention.

Referring now more particularly to the accompanying drawing, the numeral 10 indicates a conventional air cleaner and 11 a carburetor which may be of any normal construction, the carburetor 11 being in turn connected to a manifold system designed generally as 12. A distribution rectifier 20 of my invention is shown situated within a duct 13 of an inlet manifold pipe 14 in such a fashion as shown that the base 15 of the rectifier 20 rests snugly on the bottom portion 16 of said inlet pipe 14. In effect, the distribution rectifier 20 is secured therein and is not free to move due to the close confines of the inlet pipe 14. FIG. 1 depicts the preferred position of the distribution rectifier 20 comprising a cylindrical structure 17 and a curved member 18 affixed to said cylindrical structure 17 along the peripheral edges 19 thereof. The construction of said cylindrical structure 17 and curved member 18 is such that it is foraminous, that is the structure has a multiplicity of apertures therein.

It will be appreciated that the position of the rectifier within the intake manifold and its close proximity to the outtake manifold (not shown) allows for the rectifier to be heated and thus to facilitate the vaporization of the fluid fuel. It is to be understood, however, that the means used to impart heat to the distribution rectifier is immaterial so long as the same is adequately heated to a temperature adequate to vaporize the atomized fuel particles passing from the carburetor.

It is a requirement of the instant invention that the member 18 have a curved or curvelinear surface. Although a preferred structure is that of a cone or turncated cone, it will be appreciated that other curved members may be readily utilized such as those defined by a segment of a sphere or a hemispherical configuration as well as ellipsoidal segments and parabolical segments.

Figure 2:
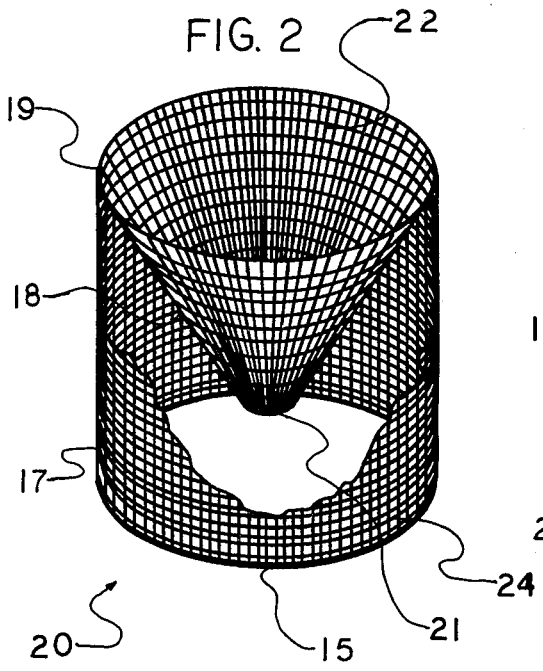
FIG. 2 is an enlarged front elevation of the subject device showing a cut away portion thereof.

It will be noted from FIG. 2 that the curved member 18 tapers downwardly and is provided with a minor orifice 21 therein as opposed to a major orifice 22. It can be seen that the curved member 21 extends into the cylindrical member 17 to a position intermediate the top and bottom of the cylindrical member. The cylindrical member 17 may be readily secured to the curved member 18 by any number of suitable means such as welding, brazing and various other metal coupling contrivances. It is important to note that the major opening 22 in relation to the minor opening 21 is substantially larger and axially spaced therefrom. In general it has been found that the preferred range of relative dimensions for the subject rectifier have a ratio of major to minor opening areas of from about 15:1 to about 10:1 with a preferred ratio being about 12:1.

Figure 3:
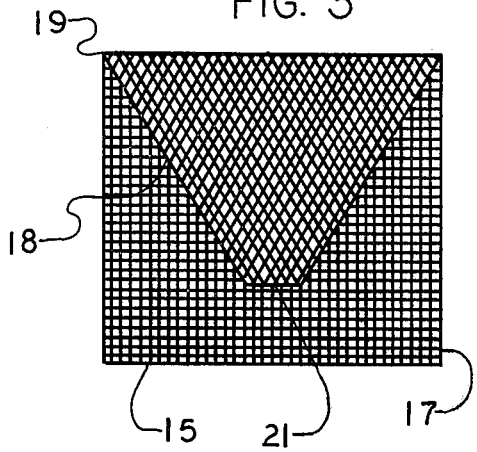
FIG. 3 is a cross-sectional view of the distribution rectifier.
Figure 4:
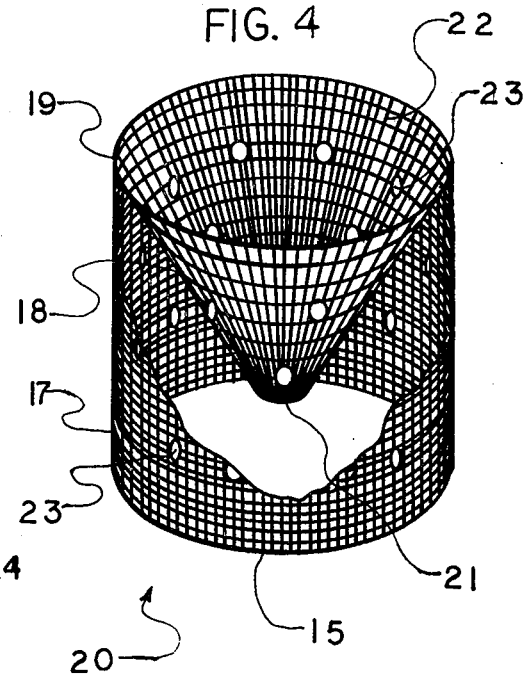
FIG. 4 is a cut-away view of the subject rectifier showing another embodiment thereof.

The above mentioned feature which has been particularly advantageous in the subject invention is the establishment of the minor orifice axially within the curved member in that such an orifice allows the fluid fuel to pass therethrough more readily upon fast acceleration. Thus the atomized fuel is carried into the rectifier and due to the somewhat restricted curved shape the fuel will be brought into turbulence and subsequent vaporization. In this manner, the fuel in passing through the rectifier will be completely vaporized and mixed so that complete combustion of the mixture within a cylinder will be accorded. In effect, a less amount of fuel will be used, that is there is an improvement in the mileage covered per gallon of gasoline. FIG. 3 depicts the subject invention, sectioned in half in order to better demonstrate the structure. Here, a conical member 18 is shown connected along the peripheral edges 19 or juncture to the cylindrical member 17. FIG. 4 shows a preferred embodiment of the subject invention in that an array of perforations 23 are defined through members 17 and 18. This particular embodiment represents a versatile expedient suitable for effective vaporization for internal combustion engines. It has been found that these perforations have an apparent regulatory effect upon the efficiency of the subject device. It has been found that the area defined by a single perforation be about one-fourth the area of the minor orifice of the conical member. Structurally, the cylindrical and curved members are formed with perforations located circularly and substantially equiangularly spaced of said members. The perforations are functional in affording the aforementioned regulatory effect when increase demands are mode for a fuel rich mixture since this configuration offers less stricture on the conveyed steam. Moreover, through the use of said integrally associated perforations an engine substantially runs smoothly without delays in quick changes in velocities.

Although the particular type of foraminous structures to be utilized in accordance with this invention may be varied over a wide scope, there are preferred ranges which provide the benefits herein. It has been found that the mean diameter of the apertures of the foraminous structure should be about commensurate with the mean diameter of the fluid droplets of the fuel being dispersed in a conveyed stream. The foraminous structure may range from one having about 10 to 20 openings per linear millimeter (mesh count) and preferably about 12 and a dimension of about 0.1 to 0.8 millimeters and preferably about 0.5 measured between and normal to adjacent filaments or wires (aperture opening) of the structure. The apertures may be of varied geometric form, but the square-mesh filamentary gauze type is most preferred. Other suitable apertured structures include triangular and hexagonal types and perforated plate with round holes, parallel bars or wires as well as slit-end square-hole perforated plate structures.

The material forming the distribution rectifier of the instant invention may be made from numerous types of materials but it has been found advantageous to have the same made of metal and especially steel alloyed with chromium such as stainless steel as such alloys are virtually immune to corrosion.

It is believed that a careful consideration of the specification in conjunction with the means of the drawing will enable the reader to obtain a clear and comprehensive understanding of the subject matter of the invention, the features and advantages, mode of use and improved result which is assured the user.

The foregoing is considered as illustrative only of the principles of the invention. Further, since a number of modifications and changes will readily occur to those skilled in the art, it is not desired to limit the invention to the exact construction shown and described, and accordingly all suitable modifications and equivalents may be resorted to, falling within the scope of the invention as claimed.

I claim:

1. In a carburetor system for internal combustion engines which includes a carburetor for supplying a mixture of fluid fuel and air and an intake manifold, a distribution rectifier situated after said carburetor and in direct contact with the intake manifold, said distribution rectifier comprising a foraminous cylindrical member having an opening at the upstream end thereof, the bottom portion of said foraminous cylindrical member in direct contact with the intake manifold and closing the bottom portion of the downstream end thereof, a foraminous curved member attached along its peripheral edge to said cylindrical member at the upstream end thereof, said curved member having a major orifice coextensive with the opening of the upstream end of said cylindrical member, and a minor orifice defined at the apex of said curved member, said minor orifice being situated axially within and substantially at an intermediate portion of said cylindrical member.

2. A distribution rectifier as recited in accordance with claim 1 wherein the ratio of areas defined by the major orifice to the area defined by said minor orifice is between about 15:1 to about 10:1.

3. A distribution rectifier as recited in accordance with claim 2 wherein the ratio is about 12:1.

4. A distribution rectifier as recited in accordance with claim 1 wherein said rectifier is provided with a plurality of perforations.

5. A distribution rectifier as recited in accordance with claim 4 wherein the area defined by a single perforation is about one-fourth the area defined by the minor orifice of said curved member.

6. A distribution rectifier as recited in accordance with claim 1 wherein said rectifier is made of stainless steel.

7. A distribution rectifier as recited in accordance with claim 1 wherein the curved member is a turncated cone.

8. In a carburetor system for internal combustion engines which includes a carburetor for supplying a mixture of fuel and air and an intake manifold, a distribution rectifier situated after said carburetor and in direct contact with the intake manifold, said distribution rectifier consisting of a foraminous cylindrical member having an opening at the upstream end thereof, the bottom portion of said foraminous cylindrical member in direct contact with the intake manifold and closing the bottom portion of the downstream end thereof, a foraminous curved member attached along its peripheral edge to said cylindrical member at the upstream end thereof, said curved member having a major orifice coextensive with the opening of the upstream end of said cylindrical member, and a minor orifice defined at the apex of said curved member, said minor orifice being situated axially within and substantially at an intermediate portion of said cylindrical member.

* * * * *